US010433658B1

(12) United States Patent
Kologe

(10) Patent No.: US 10,433,658 B1
(45) Date of Patent: Oct. 8, 2019

(54) TRAY DIVIDER PANEL ATTACHMENT FOR WIRE-SIDED TRAYS

(71) Applicant: Joseph F. Kologe, Scranton, PA (US)

(72) Inventor: Joseph F. Kologe, Scranton, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 0 days.

(21) Appl. No.: 16/129,287

(22) Filed: Sep. 12, 2018

(51) Int. Cl.
*A47F 5/00* (2006.01)
*A47F 3/14* (2006.01)
*A47F 1/12* (2006.01)

(52) U.S. Cl.
CPC ..... *A47F 5/005* (2013.01); *A47F 1/126* (2013.01); *A47F 3/14* (2013.01)

(58) Field of Classification Search
CPC ..... A47F 5/005; A47F 1/126; A47F 3/14
USPC ..... 211/184
See application file for complete search history.

(56) References Cited

U.S. PATENT DOCUMENTS 2,572,090 A * 10/1951 Allen ..... F25D 25/02 211/134
3,750,894 A * 8/1973 Jensen ..... A47F 5/005 211/184
4,671,002 A * 6/1987 Fast ..... G09F 1/04 40/584
4,693,382 A * 9/1987 Galen ..... A47B 57/58 211/184
4,987,692 A * 1/1991 Fast ..... A47F 5/0869 40/642.01
5,082,125 A * 1/1992 Ninni ..... A47F 5/0823 108/61
5,134,942 A * 8/1992 Turnwald ..... A47B 87/0269 108/24
5,384,937 A * 1/1995 Simon ..... H02G 3/0443 211/181.1
5,437,380 A * 8/1995 Peay ..... A47F 5/0056 108/61
6,023,024 A * 2/2000 Stjerneby ..... H02G 3/0443 174/95
6,193,434 B1 * 2/2001 Durin ..... H02G 3/0443 403/309

(Continued)

FOREIGN PATENT DOCUMENTS

FR 2600873 A1 * 1/1988 ..... A47F 5/005

*Primary Examiner* — Stanton L Krycinski
(74) *Attorney, Agent, or Firm* — St. Onge Steward Johnston & Reens, LLC

(57) ABSTRACT

A clip-on side panel for attachment to a wire side guide of a product display tray. Many product display trays have width-adjustable wire guides at each side to confine the products into a front-to-back column. Many soft products, however, such as bagged products, can project through the open areas of the wire guides and cause problems. Trays are available with flat metal sides, but at a greater cost. The side panel attachment is an inexpensive, extruded, flat panel with an integral clip extending lengthwise at the level of the horizontal guide wire. The panel has openings at the base for engaging vertical end portions of the guide wire. The panels can be very quickly and easily installed on the guide wires of a tray for more effective confinement of soft products. The panels can just as easily be removed for other products, such as boxes, to provide greater visibility.

16 Claims, 6 Drawing Sheets

(56) References Cited

U.S. PATENT DOCUMENTS

| | | | | |
|---|---|---|---|---|
| 6,805,250 | B2 * | 10/2004 | Ondrasik | A47F 5/005 211/184 |
| 6,855,884 | B2 * | 2/2005 | Spagnoli | H02G 3/0443 174/100 |
| 6,866,155 | B2 | 3/2005 | Nagel | |
| D511,677 | S * | 11/2005 | DeBiasio, Jr. | D8/354 |
| 7,476,801 | B1 * | 1/2009 | Davis | E04F 15/0247 108/108 |
| 7,544,895 | B2 * | 6/2009 | Penichon | H02G 3/0443 174/135 |
| 7,681,746 | B2 * | 3/2010 | Schmidt | A47F 5/005 211/184 |
| 7,903,924 | B2 * | 3/2011 | Pollard, Jr. | G02B 6/4459 211/106 |
| 8,097,808 | B2 * | 1/2012 | Quertelet | H02G 3/0443 174/95 |
| 8,177,172 | B2 * | 5/2012 | Quertelet | H02G 3/0608 248/68.1 |
| 8,210,367 | B2 | 7/2012 | Nagel et al. | |
| 2001/0044992 | A1 * | 11/2001 | Jahrling | A47B 55/02 24/563 |
| 2006/0049125 | A1 * | 3/2006 | Stowell | A47B 57/583 211/184 |
| 2006/0243684 | A1 * | 11/2006 | Scharff | A47F 5/005 211/59.4 |
| 2007/0029451 | A1 * | 2/2007 | Spagnoli | H02G 3/0443 248/49 |
| 2008/0179474 | A1 * | 7/2008 | Johnson | A47F 5/083 248/214 |
| 2013/0075352 | A1 * | 3/2013 | Mitten | A47F 5/005 211/59.2 |

* cited by examiner

TRAY DIVIDER PANEL ATTACHMENT FOR WIRE-SIDED TRAYS

FIELD OF THE INVENTION

The invention relates to the field of product display trays widely used in large stores and supermarkets to present packaged products in orderly front-to-back columns.

BACKGROUND OF THE INVENTION

Trays for the display of packaged merchandise are well known and widely used. An example of such trays is shown in U.S. Pat. No. 6,866,155, illustrating a tray formed mostly of wire and having width-adjustable side wires for the lateral confinement of packages. A spring-operated pusher is positioned behind a column of packages and continually urges them forward. When a customer removes a package from the front of the tray, the entire column of packages is automatically moved forward by the pusher in order to keep a package at all time in a frontmost position, where it can easily be seen and removed by a subsequent customer.

While wire-sided trays, such as represented in the above-mentioned '155 patent are simple and inexpensive, and very efficient for the display of hard packages, such as boxes, cans, bottles and the like, they can be less than ideal for certain soft packages, such as bags, which can project laterally through the wide open side areas of their side wire confinements. For soft packages, it is often desirable to provide trays with panel side walls. An example of such a tray is shown in U.S. Pat. No. 8,210,367. The tray illustrated in the '367 patent has width adjustable side wall panels that are formed of flat metal, typically steel, which can fully confine the lower portions of soft packages. Trays with metal side walls may sometimes be required, as where the side walls provide cantilever support for the trays. In other cases, as where the trays are supported on store shelves, trays with panel side walls are less desirable, unless required for the display of soft packages, because they are more costly and also reduce the visibility of the displayed products. Accordingly, there is a need for product display trays of the types above described, which can be provided with the preferred open wire side confinement while at the same time being easily and quickly converted to panel-sided trays, if necessary, or desirable for the display of soft packages.

SUMMARY OF THE INVENTION

The invention relates to a simple and inexpensive side wall panel attachment for wire-sided trays, which enables such trays to be quickly converted to panel-sided trays when desired for the display of soft packages. The invention is directed to an advantageous form of extruded plastic side wall panel which can be quickly and easily attached to the side wires of an existing wire-sided tray to quickly convert it to a panel-sided tray. The side wall extrusion incorporates an integral clip, engagable with a horizontally extending side wire to provide a quick, snap-on assembly. Openings in lower portion of the extruded panel engage with lower portions of the wire side guide to stabilize the panel in a vertical orientation aligned with the wire side guide of the tray.

As quickly and easily as the side panels may be installed, they may just as easily and quickly be removed if they are no longer needed for the particular packages being displayed. Each panel is just a single piece, so they may be easily stored for efficient use and re-use.

The side wall panel attachment of the invention can be provided in different wall heights; a low panel, the top of which is just slightly above the level of the horizontal side wire provided on the tray; and a high panel that extends to a height almost double that of the low panel. The design of the panels is such that the extrusion dies necessary to produce them can be designed and constructed at low cost.

For a more complete understanding of the above and other features and advantages of the invention, reference should be made to the following detailed specification of preferred embodiments of the invention and to the accompanying drawings described below.

DETAILED DESCRIPTION OF THE INVENTION

Figure 1:
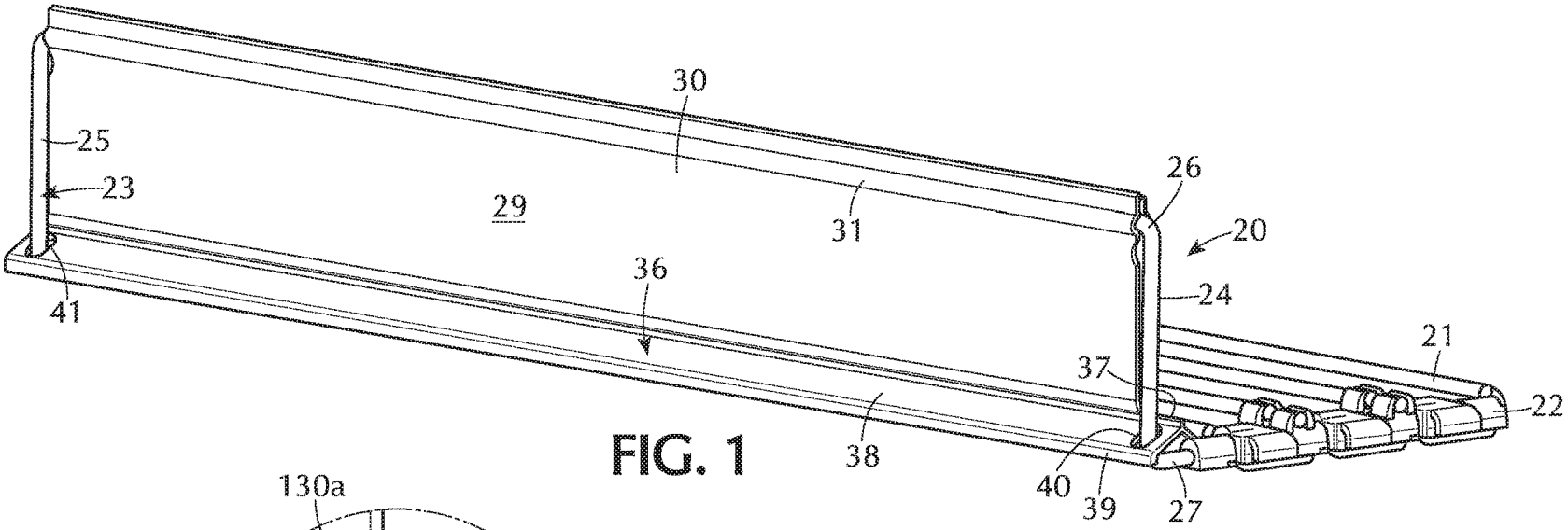
FIG. 1 is an orthographic view, from above and in front, of one preferred embodiment of the invention, illustrating a tray with low side panel attachment.
Figure 3:
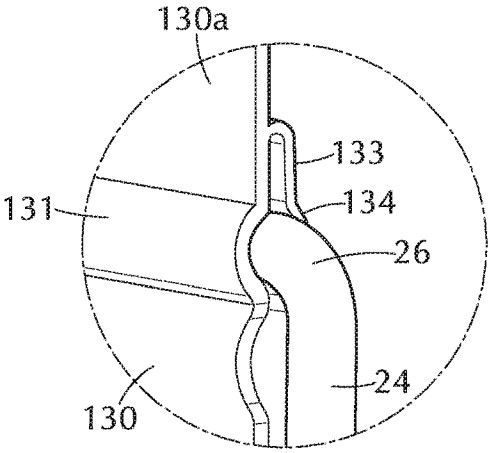
FIG. 3 is an enlarged fragmentary view of detail "A" of FIG. 2.

Referring to the drawings, and initially to FIGS. 1, 4, 6 and 7 thereof, the reference numeral 20 designates generally a wire-sided product display tray which, for convenience, is shown with a product confinement guide on only one side, it being understood that a typical functional tray will have product guides on both sides to confine the displayed products to an orderly, front-to-back column. The tray 20 can be of the general type shown in the before-mentioned U.S. Pat. No. 6,866,155 and includes a base comprised of a plurality (typically 4) of longitudinally extending wires 21 mounted on front and back molded plastic base members 22, of which only the front base member is visible in the drawings. The base wires 21 typically are welded to front and back transverse wires (not shown) to form a rigid, rectangular base structure. The transverse wires extend underneath the base wires 21 and are snap-in assembled to the base members 22 such that the wires 21 and base members 22 form a more or less permanent assembly.

Typically, the disclosed trays are provided with a spring-urged pusher device 28, which is mounted on the longitudinal base wires 21 and constantly urges the displayed products toward the front of the tray.

The tray 20 has a wire side 23 which is comprised of front and back vertical wires 24, 25 connected at their tops by an elongated, horizontally extending side wire 26. The vertical wires 24, 25 are joined at their lower ends with horizontal, inwardly extending mounting wires 27, which are frictionally received in transversely extending recesses (not shown) provided in the base members 22. The mounting wires 27 typically are approximately as long as the base members and, when fully inserted therein, as shown in the drawings, result in a tray of minimum width. For wider products, the mounting wires 27 are pulled outward on one or both sides of the tray as necessary to accommodate a wider product.

As will be appreciated, the wire sides 23 are light weight, inexpensive and fully functional for the display of products in containers which are formed of a rigid material or are otherwise able to retain their shape. For some products, however, such as products sold in bags, for example, the extensive open area of the wire sides can allow portions of the soft packages to project laterally outward of the confining planes defined by the vertical wires 24, 25 and the elongated horizontal wires 26. In such cases, packages in one tray may engage with packages in an adjacent tray, or with the hardware of an adjacent tray, causing problems. The present invention enables those issues to be quickly resolved by the attachment of a flat side panel 29 to the wire side 23 to provide for physical confinement of soft packaging. As reflected in FIGS. 1. 4, 6 and 7 one embodiment of the side panel 29, forming a low side wall, is formed of an elongated panel 30 of a length to extend horizontally a distance to fit between the front and back vertical wires 24, 25. The panel 30 is also of a height to extend vertically in a space between the elongated horizontal side wire 26 and a level slightly above the base wires 21.

At its upper edge, the side panel 29 is formed with a wire-gripping section 31 of arcuate, outwardly convex contour, which extends the full length of the side panel and is configured to receive one side of the horizontal side wire 26. A portion 32 of the side panel extends vertically upward for a short distance (e.g., 0.25 inch) above the wire-gripping section 31 and connects with a wire-clip section 33 which extends downwardly on the inside of the panel extension 32. At its lower end, the wire-clip section joins with an arcuate wire-gripping portion 34 of inwardly convex contour, positioned opposite the wire-gripping section 31. The lower edge of the wire-gripping portion 34 is provided with a short guide flange 35, which extends downward and inward. As will be more fully described, the side wall 29 can be quickly attached to the horizontal side wire 26 by positioning the panel 30 between the vertical wires 24, 25 and on the outside of the wire 26, such that the inside surface of the panel is in contact with the side wire 26 and the wire gripping elements 31, 31 lie above the wire 26. By pulling downward on the side wall 29, the guide flange 35 opens the wire-clip section 33 enabling the horizontal wire 26 to be resiliently gripped along its full length between the arcuate gripping elements 31, 33. Desirably, the gripping elements are symmetrically contoured so that the plane of the panel 30 is close to the centerline of the horizontal wire 26, when the side wall 29 in mounted on the wire.

In accordance with an aspect of the invention, the side wall 29 is provided with means spaced below the wire-gripping elements 31, 34 to engage the front and back vertical wires 24, 25 and/or the mounting wires 27 in order to stabilize the side wall 29 in a vertical orientation. As reflected particularly in FIGS. 1, 4, 6 and 7, the extruded side wall includes an integral panel base 36 along the lower edge of the panel 30 which projects forward beyond the front vertical wire 24 and rearward beyond the back vertical wire 25. In the illustrated embodiment, the panel base has a first portion 37, which extends inward and downward from the lower edge of the panel 30, and a second portion 38, which extends downward and outward from the lower edge of the first portion 37. Preferably, a short section 39 extends downward from the lower edge of the second portion 38.

In a representative but non-limiting embodiment of the invention the side wall 29 may be extruded of material such as PVC. It may have an overall height of about 3.14 inches and a thickness of about 0.055 inch. The lower or second portion 38 of the panel base may be disposed an angle of about 60° to the vertical, and about 55° with respect to the upper or first portion 37 of the panel base.

At the projecting front and back end extremities of the panel base 36, openings 40, 41 are provided for the reception of the horizontal mounting wires 27 and the front and back vertical wires 24, 25. In the extruded production of the side wall 29, as it exits from the extruder and is cooled and solidified, the openings 40, 41 are formed by suitable punch operation, preferably at right angles to the plane of the side wall 29. When installing the side wall 29 on a wire side 23, the mounting wires 27 at the front and back are first inserted into the openings 40, 41, in an outside-in direction. The insertion continues until the vertical wires 24, 25 are in the openings and the wire gripping elements 31, 34 are above the horizontal side wire 26. At this point the top of the side wall 29 is pressed downward, to force the gripping elements 31, 34 over the wire 26, firmly attaching the side wall 29 to the wire. As reflected in FIGS. 1 and 4, the lower or second portion 38 of the panel base 36 engages the two vertical wires 24, 25 near the bottoms thereof to orient and stabilize the side wall 29 is a vertical position, substantially in a plane defined by the horizontal and vertical wires 26, 24, 25 of the wire side 23.

With reference to FIGS. 2, 3, 5, 8 and 8, there is shown a second embodiment of the invention, in which the side wall extends upward a distance above the horizontal side wire 26 on which it is mounted. In the illustrated second embodiment, the tray is identical to that shown in FIGS. 1, 4, 6 and 7, and the elements thereof are identified with the same reference numerals as used in connection with the first embodiment. Likewise, many of the elements of the side wall of the second embodiment are the same as in the first embodiment, and such common elements are identified with reference numerals similar to those used in connection with the first embodiment but with 100 added to corresponding reference numerals.

Figure 2:
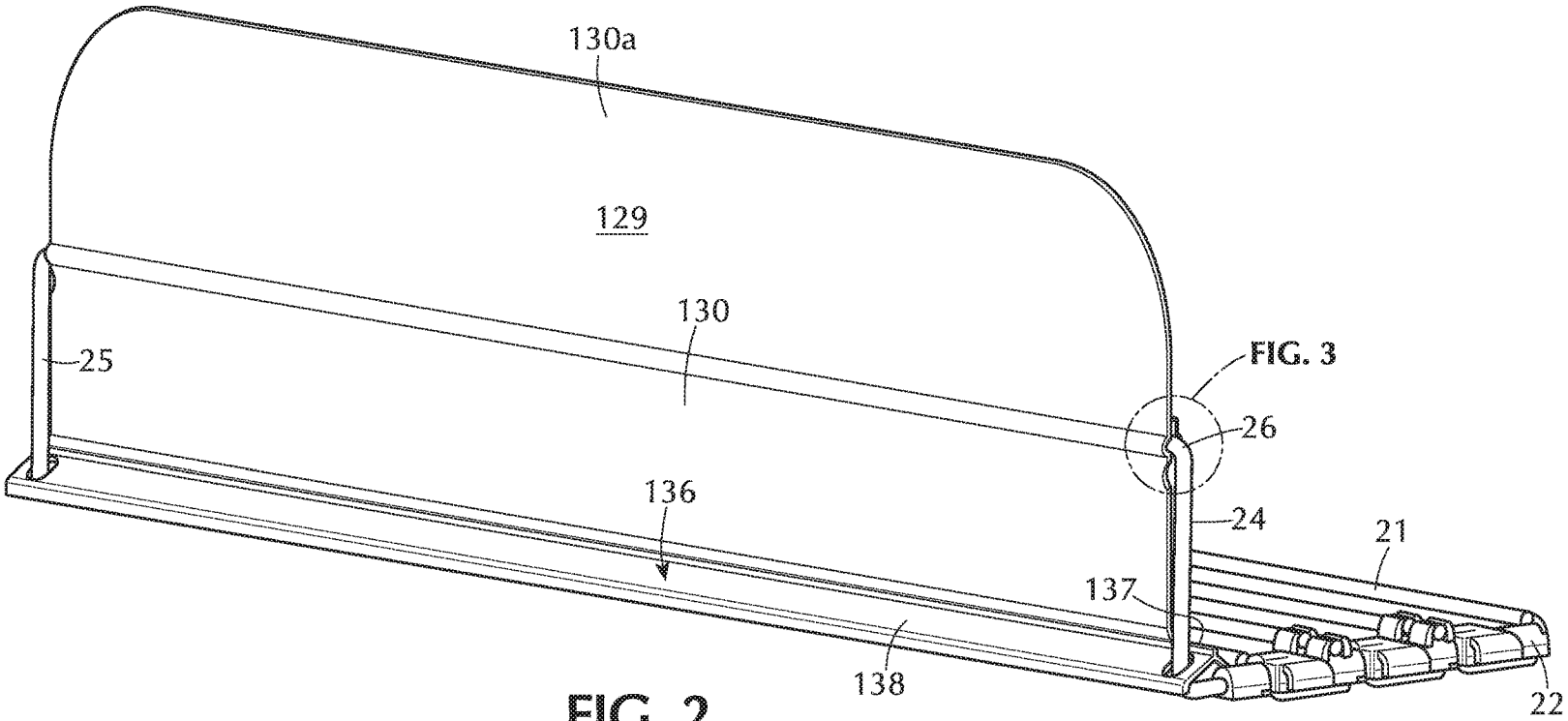
FIG. 2 is an orthographic view, from above and in front, of a second preferred embodiment of the invention, illustrating a tray with a high side panel attachment.
Figure 4:
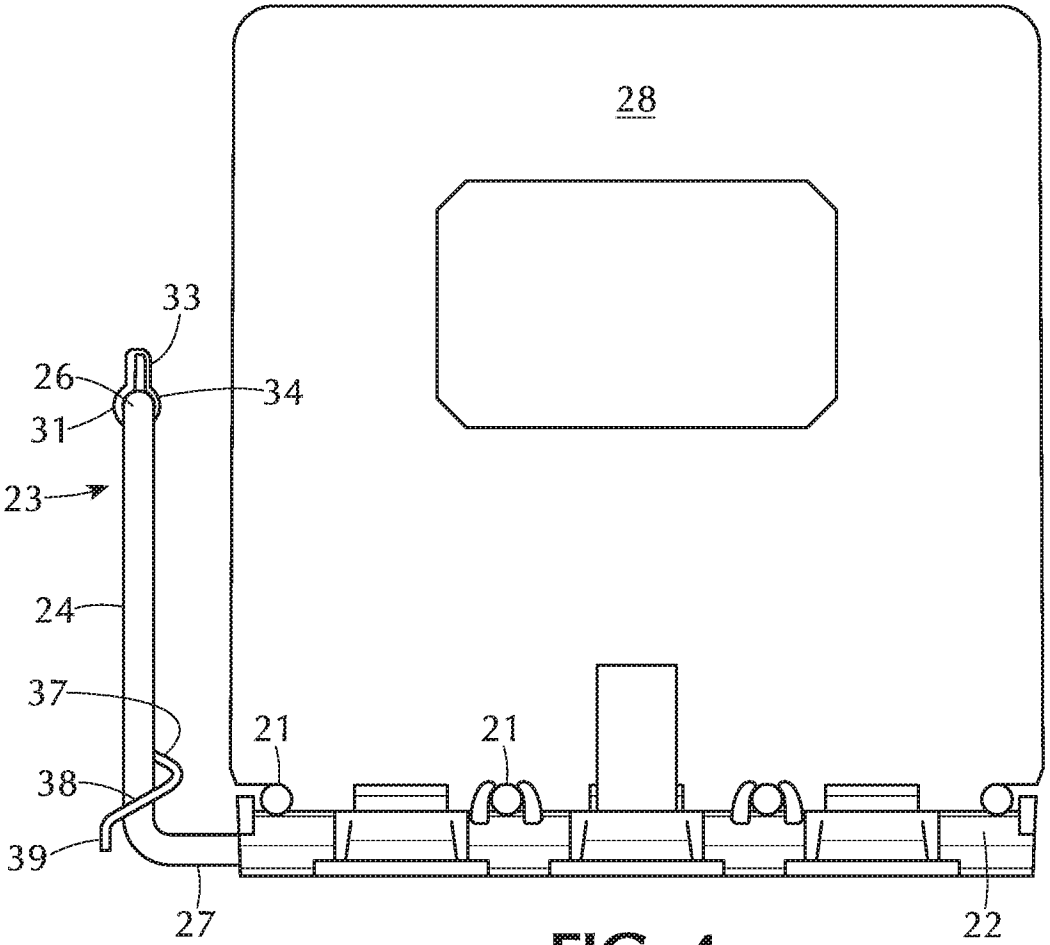
FIG. 4 is a front elevational view of the tray of FIG. 1.
Figure 5:
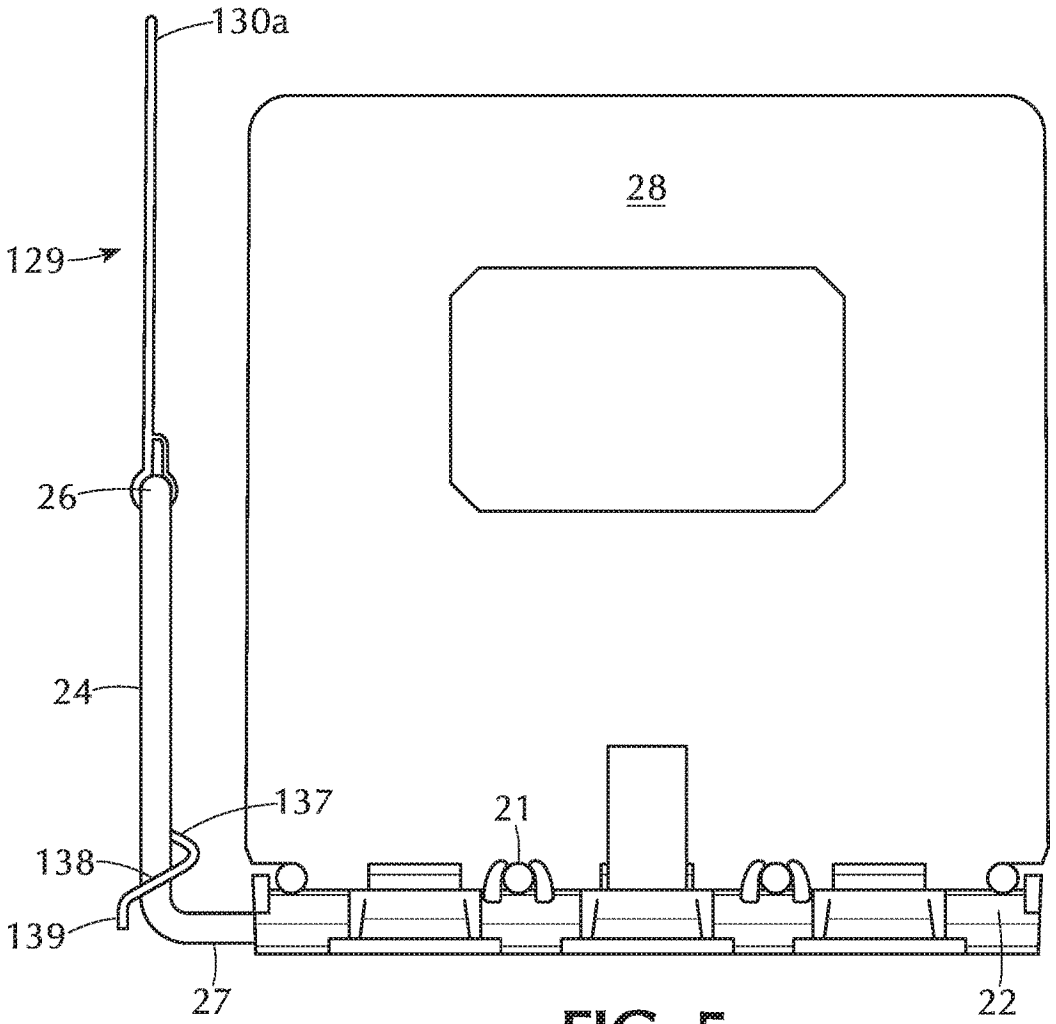
FIG. 5 is a front elevational view of the tray of FIG. 2.
Figure 7:
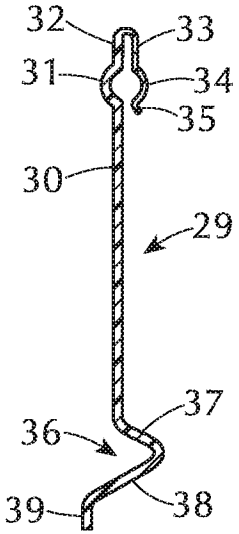
FIG. 7 is a cross sectional view as taken generally along line 7-7 of FIG. 6.
Figure 6:
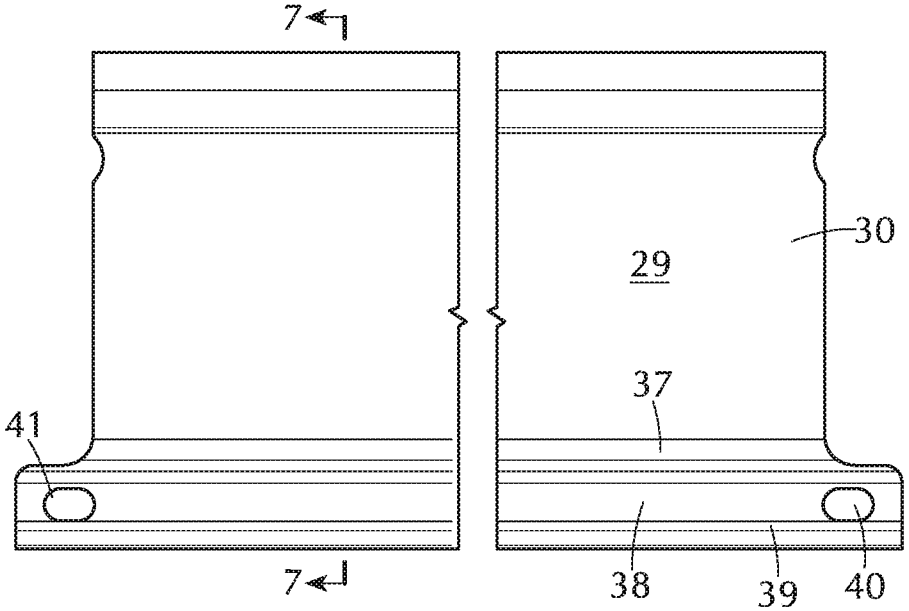
FIG. 6 is a side elevational view of a low side panel according to the invention.
Figure 9:
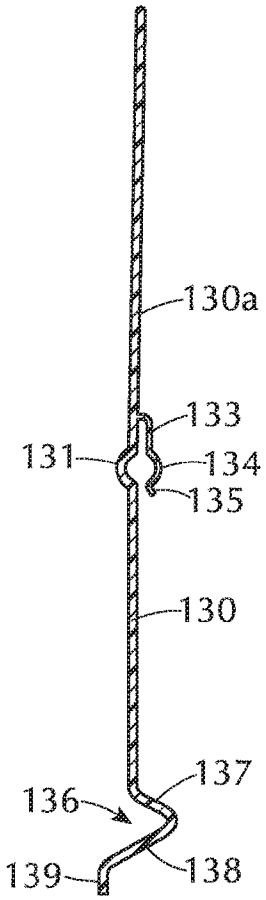
FIG. 9 is a cross sectional view as taken generally along line 9-9 of FIG. 8.
Figure 8:
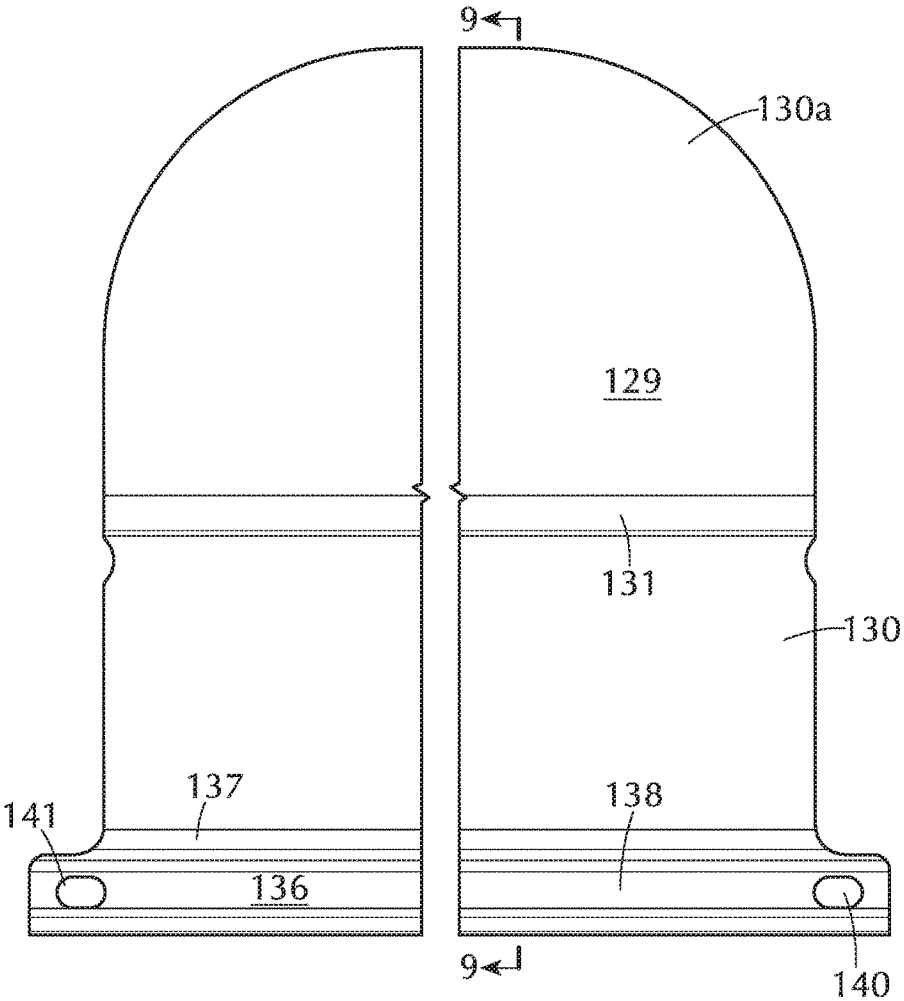
FIG. 8 is a side elevational view of a high side panel according to the invention.

Referring now to FIG. 2, the flat panel side wall 129 corresponds in all respects to the side wall 29 of FIG. 1, except that the side wall 129 has an upper panel **130*a* which extends upward an additional approximately 3 inches, providing an overall height of the side wall 129 of about 6 inches. As shown in FIG. 9, the upper panel 130*a* is in the same plane as the lower plane. The upper and lower panels 130 and 130*a* are integrally joined by an arcuate wire gripping section 131 which is positioned and configured to engage one side of the horizontal wire 26. The opposite side of the horizontal wire 26 is engaged by the wire gripping portion 134 of a wire clip section 133 that is joined with the upper panel 130*a* at a distance (e.g., 0.25 inch) above the wire gripping section 131 and extends downward along the inside of the upper panel 130*a*. The wire gripping portion 134 is positioned opposite the wire gripping section 131 and is of similar configuration. A guide flange 135 extends downward and inward from the lower edge of the wire-gripping portion 134 to assist in guiding the wire 26 into the clip. Preferably, the wire clip section 133 is somewhat thinner than the panels 130, 130*a* and is easily deflected when installing the side wall 139 onto a side wire 26**.

Attachment of the high side wall 129 to the side wire 26 is performed in the same manner as for the low side wall 29. The wire side 23 is detached from its tray, allowing the mounting wires 27 to be inserted into the panel base openings 140, 141. Before inserting the mounting wires 27, the side wall panels 130, 130*a* are positioned on the outer side of the horizontal wire 26 and between the vertical wires 24, 25. Thus, as the mounting wires 27, and then the vertical wires 24, 25, enter the openings, the horizontal wire 26 can be aligned with the space between the wire gripping elements 131, 134 and can be pressed into engagement therewith. To remove the side wall panel 129 and restore the tray to its original form, the wire side is first detached from the front and back tray bases 22. The wire gripping elements 131, 134, are spread apart at one end to enable the wire 26 to be removed from the clip, and the wire sections 24, 25 and 27 are withdrawn from the panel base openings 140, 141. The mounting elements 27 are then reinserted in the base members 22, restoring the tray to its original configuration.

The invention provides a uniquely simplified, convenient and inexpensive way to convert a wire-sided tray to a panel-sided tray where necessary or desirable to accommodate soft packages that may not be well confined by wire-sided trays. The conversion is accomplished by the clip-on attachment of an extruded plastic panel to the elongated horizontal wire of an existing wire-sided tray, in conjunction with means for retaining the plastic panel in a vertical orientation. In the illustrated form of the invention the panel is retained in a vertical orientation by engagement of lower portions of the panel with existing elements of the wire side guide. Just as easily as a wire-sided tray may be converted to a panel-sided tray, the tray may be re-converted to wire-only confinement where such might be preferred. The entire process of conversion and/or re-conversion is quickly accomplished, requires no tools nor any special skills.

It should be understood, however, that the embodiments of the invention herein illustrated and described are intended to be representative of the invention and not in any way in limitation thereof, as certain changes may be made therein without departing from the clear teachings of the disclosure. Accordingly, reference should be made to the appended claims in order to determine the full scope of the invention.

What is claimed is:

1. A side panel of extruded plastic construction for installation on a wire-sided product display tray, where the product display tray has one or more wire sides comprised of an elongated, horizontally extending side wire section, front and back vertical wire sections extending downward from opposite ends of the side wire section, and horizontal mounting wire sections extending from lower ends of said vertical wire sections, at right angles to the side wire section and to the vertical wire sections, said horizontal mounting wire sections being adjustably engagable with bottom structure of said product display tray for supporting and positioning said horizontally extending side wire section with respect to said bottom structure, which comprises, an elongated panel of a length to extend horizontally in a space between said front and back vertical wire sections, and of a height to extend vertically in a space from said horizontally extending side wire section and toward said horizontal mounting wire sections, a wire gripping section extending longitudinally along said panel and positioned and configured to engage the side wire section, a wire clip section integrally connected with said panel and having a wire gripping portion positioned in opposing relation to said wire gripping section and operative with said wire gripping section to resiliently grip and retain said elongated, horizontally extending side wire section, a panel base connected with a bottom portion of said panel, said panel base having portions at each end configured to extend forwardly beyond the front vertical wire section and rearwardly beyond the back vertical wire section, said panel base having an opening therein adjacent each end for the reception and passage of front and back lower portions of said wire sides.

2. A side panel according to claim 1, wherein said panel base has a first base portion connected to a bottom of said panel and extending downward and laterally in one direction with respect to a plane of said panel, and a second base portion connected to a bottom of said first base portion and extending downward and laterally in an opposite direction with respect to the plane of said panel.

3. A side panel according to claim 2, wherein said first base portion extends downward and laterally inward with respect to the plane of said panel, and said second base portion extends downward and laterally outward with respect to the plane of said panel, and said openings in said panel base comprise an opening in said second base portion, adjacent to each end thereof.

4. A side panel according to claim 3, wherein said openings are formed in said second base portion along axes transverse to the plane of said panel, portions of said horizontal mounting wires are initially passed through said openings, and portions of said vertical wire sections are received in said openings when said panel is engaged by said wire gripping section and said wire clip section.

5. A side panel according to claim 1, wherein said wire gripping section is positioned adjacent to a top of said panel.

6. A side panel according to claim 5, wherein said wire gripping section forms the top of said panel.

7. A side panel according to claim 5, wherein said wire clip section has a first portion extending upward from said wire gripping section and a second portion extending downward from a top of said first portion, and said second portion is engageable with said horizontally extending side wire section opposite to said wire gripping section.

8. A side panel according to claim 1, wherein said elongated panel has a first portion extending downward from said wire gripping section and a second portion extending upward from said wire gripping section for a distance above said wire clip section.

9. A side panel according to claim 8, wherein a first portion of said wire clip section comprises a lower portion of the second panel portion, and a second portion of said wire clip section comprises an element integral with said second panel portion, extending downward in spaced relation to said second panel portion and having said wire gripping portion along a lower edge thereof.

10. A side panel of extruded plastic construction for installation on a wire sided product display tray, where the product display tray has one or more wire sides comprised of an elongated, horizontally extending side wire section, front and back vertical wire sections extending downward from opposite ends of the side wire section, and horizontal mounting wire sections extending from lower ends of said vertical wire sections, at right angles to the side wire section and to the vertical wire sections, said horizontal mounting wire sections being adjustably engageable with bottom structure of said product display tray for supporting and positioning said horizontally extending side wire section with respect to said bottom structure, which comprises, an elongated panel of a length to extend horizontally in a space between said front and back vertical wire sections, and of a height to extend vertically in a space from said horizontally extending side wire section and toward said horizontal mounting wire sections, a wire clip extending longitudinally along said panel and positioned and configured to engage said horizontally extending side wire section, a panel stabilizer at each end of said panel, said stabilizers being configured to extend forwardly beyond the front vertical wire section and rearwardly beyond the back vertical wire section, each of said panel stabilizers having an opening therein for the reception and passage of front and back lower portions of said wire sides.

11. A side panel according to claim 10, wherein said panel stabilizers are part of a longitudinally extending panel base connected to a bottom of said panel and extending downward and laterally in at least one direction with respect to a plane of said panel.

12. A side panel according to claim 11, wherein said panel base comprises first and second base portions, said first base portion extends downward and laterally inward from a bottom of said panel, and said second base portion extends downward and laterally outward from a bottom of said first base portion, and said openings in said panel stabilizers comprise an opening in said second base portion, adjacent to each end thereof.

13. A side panel of extruded plastic construction for installation on a wire sided product display tray, where the product display tray has one or more wire sides comprised of an elongated, horizontally extending side wire section, front and back vertical wire sections extending downward from opposite ends of the side wire section, said horizontally extending wire section and said vertical wire sections defining a vertical plane, and horizontal mounting wire sections extending horizontally from lower ends of said vertical wire sections, at right angles to the side wire section and to the vertical wire sections, said horizontal mounting wire sections being adjustably engageable with bottom structure of said product display tray for supporting and positioning said horizontally extending side wire section with respect to said bottom structure which comprises, an elongated flat panel of a length to extend horizontally in a space between said front and back vertical wire sections, and of a height to extend vertically in a space from said horizontally extending side wire section and toward said horizontal mounting wire sections, an arcuate groove extending longitudinally along said panel and positioned and configured to engage said horizontally extending side wire section on one side thereof, and integral clip means extending from said panel and positioned and configured to engage said horizontally extending side wire section on the side thereof opposite to said arcuate groove.

14. A side panel according to claim 13, wherein said arcuate groove and said integral clip means are configured to position said panel substantially in the plane defined by said horizontally extending wire section and said vertical wire sections.

15. A side panel according to claim 14, wherein said integral clip means forms a top of said panel.

16. A side panel according to claim 13, wherein said panel has a portion extending upward from said integral clip means.

* * * * *